137-13
8/30/77 KR 4,045,092

United States Patent [19]
Keller

[11] 4,045,092
[45] Aug. 30, 1977

[54] FUEL COMPOSITION AND METHOD OF MANUFACTURE

[75] Inventor: Leonard J. Keller, Dallas, Tex.

[73] Assignee: The Keller Corporation, Dallas, Tex.

[21] Appl. No.: 615,697

[22] Filed: Sept. 22, 1975

[51] Int. Cl.[2] ..... B65G 53/30; C10L 1/32
[52] U.S. Cl. ..... 302/66; 137/13; 44/51
[58] Field of Search ..... 44/51; 302/66; 137/13

[56] References Cited

U.S. PATENT DOCUMENTS

| | | | |
|---|---|---|---|
| 1,623,241 | 4/1927 | Greenstreet | 44/51 |
| 1,681,335 | 8/1925 | Griessbach et al. | 44/51 |
| 2,131,308 | 9/1938 | Blummer | 44/51 |
| 2,461,580 | 2/1949 | Wiczer et al. | 44/51 |
| 3,389,714 | 6/1968 | Hughes et al. | 137/13 |
| 3,926,203 | 12/1975 | Marsden, Jr. et al. | 302/66 |

*Primary Examiner*—Daniel E. Wyman
*Assistant Examiner*—Mrs. Y. Harris-Smith
*Attorney, Agent, or Firm*—James C. Fails

[57] ABSTRACT

An economical fuel composition that can be readily transported and stored and that has good nonpollution properties characterized by a combustible, pseudo-thixotropic liquid-solid suspensoid including a critical proportion of coal particles having a critical settling velocity substantially uniformly dispersed in a solution of methyl fuel including methanol, water and other alcohol-soluble constituents of the coal. The critically sized and shaped coal particles are worked in the presence of the methyl fuel to become wet along all surfaces, such that the coal particles are maintained in suspension by even low intensity stirring in storage and do not separate out upon flow through a pipe line. The suspensoid has shear thinning rheological properties so as to be pumpable with a lower apparent viscosity than its at rest viscosity.

13 Claims, 2 Drawing Figures

FUEL COMPOSITION AND METHOD OF MANUFACTURE

This invention embodies technology contained in document disclosure of Nov. 7, 1974-4 by the same inventor and entitled "Methacoal, a Pseudo-Thixotropic, Mechanically Stabilized Suspensoid of Particulate Coal and Methyl Fuel, Methanol, or Methyl-Alcohol".

BACKGROUND OF THE INVENTION

1. Field of the Invention:

This invention relates to an improved fuel composition that enables making available economical fuel, such as coal, from a remote locale to more populous using markets. More particularly, this invention relates to an improved fuel composition that has all the desirable properties of a true suspension; yet, in which all of the constituents are combustible with low to zero pollution levels in the exhaust gases.

2. Description of the Prior Art:

Since the beginning of recorded time, man has attempted many approaches to obtaining power. The Industrial Revolution in the United States during the 19th century came about, in part at least, because of the ready availability of economical sources of power.

Two recent developments in the United States have, however, brought a re-evaluation of conventional technology. First, is the remarkable attention that has been devoted to improving our environment, reducing pollution and and the like. The sedcond is the so-called "energy shortage", evidenced by curtailment of deliveries of natural gas, gasoline and other petroleum products. An excellent discussion of these conventional sources of power and their shortcomings is contained in an article entitled "Hydrogen: Its Future in the Nation's Energy Economy", W. E. Winsche, K. C. Hoffman, F. J. Salzano, SCIENCE, 29 June 1973, Vol. 180, No. 4093. Therein, the authors delineate the projected need for large scale economical sources of energy; such as that derived from nuclear fission, solar or geothermal sources. In that article, the authors point out the disadvantages of several conventional sources of power and extoll the virtues of hydrogen as a potential future fuel, since it is nonpolluting.

One widely available substitute for the petroliferous fuels is coal. Moreover, in many cases, the coal contains less sulfur and other pollutants than the pertroliferous fuel. The cost of mining and transporting coal over long distances has made it noncompetitive with crude oil heretofore, since crude oil was available at a cost of about three dollars a barrel. As crude oil increases in cost to five dollars a barrel or higher, coal becomes increasingly competitive as a source of fuel. It could be particularly competitive if a way could be found to transport the coal economically; for example, coal provides energy at the cost of about 20 cents per million British Thermal Units (BTU's). Large reserves of coal are available in the United States; notably, in Alaska, Wyoming, Utah and the central states and the lignite deposits in Texas. As indicated, transportation of coal has required a disproportionately large amount of trouble and expense. A variety of proposals have been tried to solve the transportation problem. For example, it has been known to transport aqueous slurries of coal containing up to as much as 60 percent by weight of coal. This has been termed "hydraulic transport", but has been disadvantageous; since the liquid phase was water and was not combustible. When the resulting slurry was employed, it lowered the combustion temperatures too much because of the water phase that had to be evaporated. If the coal particles were small enough to remain in suspension for hydraulic transport, there was difficulty in attaining separation of the coal from the slurry at the using destination so the method has not achieved widespread commercial success.

The closest prior art of which I am aware is U.S. Pat. No. 1,681,335 disclosing stable pastes of coal in a liquid such as methanol or isobutyl alcohol such as are obtained by the catalytic reduction of the oxides of carbon under pressure. The pastes are preferably stabilized by the addition of inorganic or organic bases soluble in the alcohol, for example, alkali metal hydroxides, ammonia, methyl amine, pyridine, aniline and the like. These pastes of coal were not pumpable through pipe lines over long distances and had other disadvantages making them inappropriate for modern day technology for obtaining coal from remote locales.

Thus, it can be seen that despite the urgent need for more fuels and the ready availability of economical fuels in certain remote areas, no completely satisfactory fuel composition has been provided that would enable making these fuels available at the more populous using destinations. Specifically, experience has indicated that a fuel composition that would satisfy the modern day technology requirements should have the following features not heretofore provided by the prior art.

1. The fuel composition should be a soliquoid, or suspensoid, and behave as if it were a liquid and be precisely distinguishable from either a slurry in which suspension of the particles is maintained by turbulence or a colloidal suspension in which the particles are maintained in suspension by virtue of their extremely small size and consequent Brownian movement phenomena. The liquid fuel should have a critical proportion of solids in the liquid so as to exhibit shear thinning, thixotropic rheological properties. The fuel composition will become a slurry if too low a proportion of solids is used and become a paste, or stably shear resisting moistened mass, if too high a proportion of solids is used.

2. The fuel composition should retain its shear thinning, thixotropic rheological characteristics for extended periods of time when left in quiet storage and should be readily brought into an essentially homogeneous state by low intensity stirring, as opposed to the high intensity turbulence required to maintain a relatively homogeneous suspension of a slurry.

3. The fuel composition should not require gel producing chemical agents or colloid-producing chemical agents to maintain a stable suspension of the particulate matter in the suspensoid, but should enable the use of such chemical agents, as well as agents added for other purposes, without destroying the thixotropic character of the suspensoid.

4. The fuel composition should have critical particle sizes, shapes, surface phenomena and the like so as to have a low settling velocity below a certain critical maximum for controlling and achieving the desired shear thinning, thixotropic characteristics to enable pumping at an apparent low viscosity without settling out of the solid fuel particles.

5. The fuel composition should have its thixotropic characteristics enhanced by mechanical working, or intensification, induced by working the solid particles of fuel in the presence of the liquid.

6. The fuel composition should effect mechanical stabilization of the suspensoid by the size, shape and nature of the particles and create an appropriate amount of interparticulate space, or volume, to accommodate a minor amount of the more expensive liquid fuel to produce a high content of the more economical solids yet still have an easily handled, low effective viscosity liquid form.

7. The fuel composition should be able to be stored effectively in low pressure, sealed tanks and readily transported by the conventional means, including pipe lines, without requiring great quantities of water for coal-water slurry pipe lines or the exhorbitant costs of producing synthetic hydrocarbon liquids from coal for pipe line transport.

8. The fuel composition should be readily separable into its liquid and solid constituents for a wide variety of end uses at the using destination; including having the solid fuel at its optimum moisture content.

9. The fuel composition should be storable or transportable at temperatures below the freezing point of water.

10. The fuel composition should be pumpable through buried pipe lines at temperatures below the freezing point of water to prevent thawing of ice, tundra, or frozen soil; or to provide for freezing of adjacent material, as well as maintaining the frozen state.

11. The liquid fuel should provide for delivery of large quantities of alcohols, along with coal, the alcohols being useable either as direct combustion fuel or as a replacement for feed stocks and raw materials for chemical plants for fuel, chemical, or petrochemical industries, or for low cost conversion to gasoline.

SUMMARY OF THE INVENTION

It is an object of this invention to provide a fuel composition and method for manufacture that achieves one or more of the foregoing features not heretofore provided by the prior art.

It is a specific object of this invention to provide a fuel composition and method of manufacture that achieves a plurality of the features delineated hereinbefore and not heretofore provided by the prior art.

In a specific aspect, it is an object of this invention to provide a fuel composition and method of manufacture that achieves all of the features delineated hereinbefore as desirable and not heretofore provided by the prior art.

These and other objects will become apparent from the descriptive matter hereinafter, particularly when taken in conjunction with the drawings.

In accordance with this invention, there is provided a fuel composition that can be readily transported and stored and that has good nonpollution properties comprising a combustible, pseudo-thixotropic liquid-solid suspensoid or soliquoid, including a critical proportion of combustible carbonaceous particles having a critical settling velocity substantially uniformly dispersed in a solution of methyl fuel including methanol, water and other alcohol soluble constitutents dissolved from the combustible carbonaceous particles. The combustible carbonaceous particles are present in a proportion of 50–80 percent by weight. The combustible carbonaceous particles are sized and shaped to have a settling velocity in water of less than 2½ centimeters per second and are worked in the presence of the methanol; for example, in the methyl fuel; so as to be wet by the methanol along all surfaces. The combustible carbonaceous particles are held in suspension in the liquid-solid suspensoid by even low intensity stirring in storage and do not separate out when pumped through a pipe line. The suspensoid has shear thinning rheological properties to be pumpable with a lower apparent viscosity than its at-rest viscosity.

In specific embodiments, the combustible carbonaceous particles comprise suspended particulate coal; and the coal is reduced in size sufficiently for efficient combustion and is a −8 mesh and has a majority of the particles of size −100 mesh (no more than 150 microns in lateral dimension). The mesh sizes refer to the Tyler Standard Screens, and the minus sign indicates that the particles passed through the particular mesh delineated. The suspensoid has the particular quantity of particular sized coal particles in order to have a proper ratio of surface area to volume. If there is excessive surface area, an inordinately high proportion of the more expensive liquid methyl fuel is required in proportion to that of the more economical coal, or solid fuel. Since the methyl fuel costs about 3 to 10 times as much as the solid coal, high proportions thereof are undesirable. Specifically, the amount of coal having a size less than 10 microns (0.01 millimeters) should be no more than 1 percent, since the ratio of surface area to volume is 100:1 for that size.

DESCRIPTION OF PREFERRED EMBODIMENTS

Figure 1:
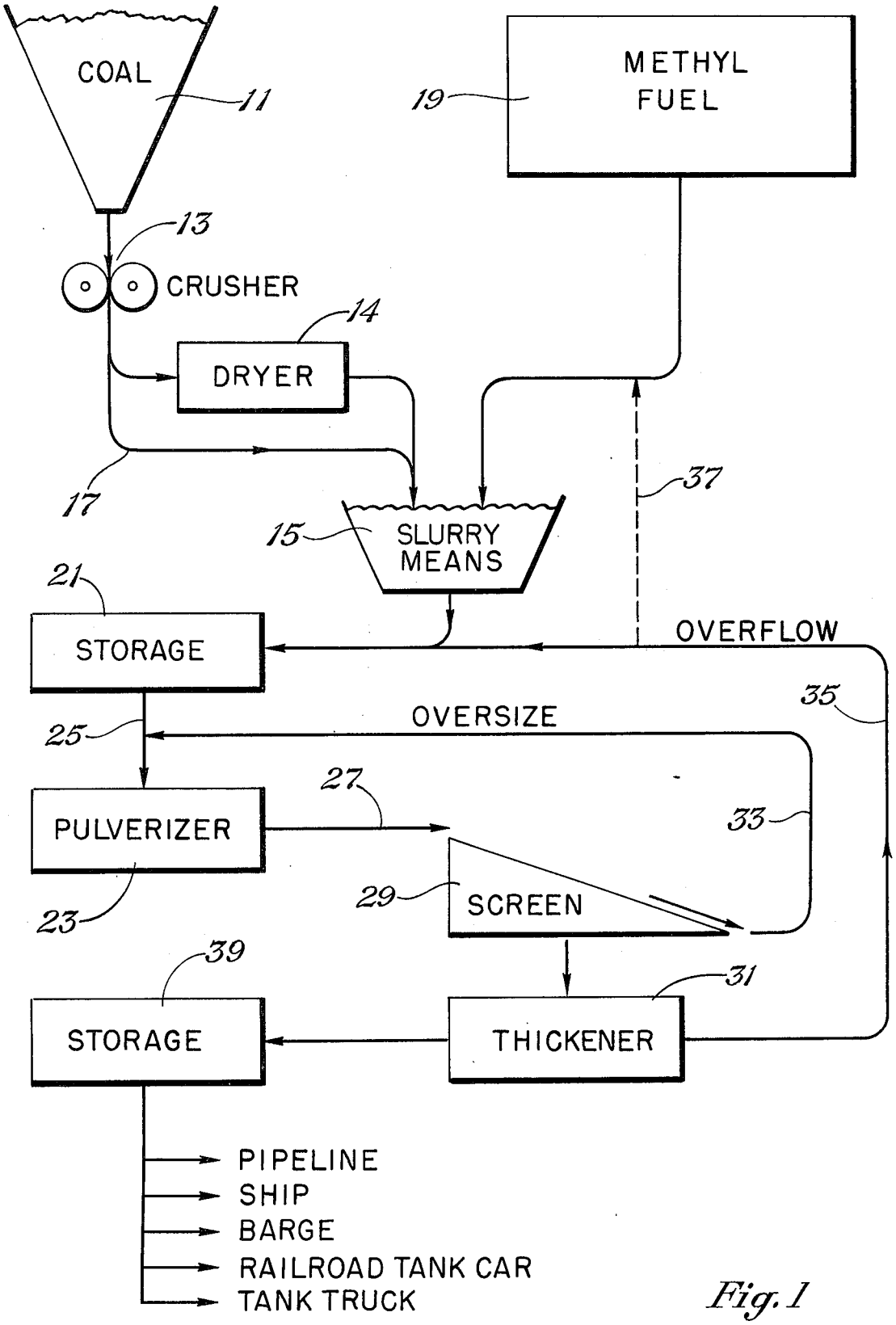
FIG. 1 is a schematic diagram of one embodiment of this invention.

The term "combustible carbonaceous particles" is used herein to mean any of the combustible, carbon-containing materials that will form the particles having the described low settling velocities and form the shear thinning liquid-solid suspensoid having the high proportion of the less expensive solids, as described herein and as vital to this invention. Such materials comprise carbon-containing shales; carbon black; pitch; the spoil banks containing the tailings from washing of coal; and, most importantly, coal. Since coal is the most important material, in terms of relieving the energy crisis in certain industrialized sectors of the country, this invention will be described in detail with respect to that embodiment.

The coal that is employed in this invention may be any of the commercially available coal, ranging from the relatively pure and high carbon content anthracite coal through the bituminous coal to the less desirable soft coals, lignites and the like.

The mining and preparation of coal is described at some length in Kirk-Othmer ENCYCLOPEDIA OF CHEMCIAL TECHNOLOGY, Second Edition, Anthony Standen, Editor, Interscience Publishers, New York, 1969, Vol. 5, Pages 606–676; and that descriptive matter is incorporated herein by reference. The coal is mined from a coal mine by either strip or underground methods, as appropriate to the respective deposit. These methods are conventional and are described on page 660 of the aforementioned Kirk-Othmer Encyclopedia.

The preparation of coal is described at page 661 in the above referenced Kirk-Othmer Encyclopedia. One advantage of this process is that it can employ the fines that were formerly discarded because of customer objections to fine coal. The exact natures of the coals in the coal deposits in various states have not been completely characterized, even though the deposits are known to be extensive. If a coal has a large amount of fusinite, it will be extremely friable, and will tend to concentrate in the fine size ranges during its preparation. This is helpful in practicing this invention, since the fines can be sent directly to a slurrying plant, or slurry means, to reduce the amount of additional work required in pulverizing the coal for forming the slurry with the methyl fuel. Similarly, and appreciable amounts of vitrinite will readily break into fine sizes of less than one millimeter to reduce the work of additional size reduction and comminution required to get the desired particle size. As is known, in making the fine particles, the amount of work is indicated by the Hargrove Index. Specifically, a low Hargrove Index indicates that more energy will be necessary in the pulverizing mill to create the coal powder. It is understood that many of the coals, such as the Alaskan coal, have a relatively high Hargrove Index; and, hence, should require relatively low power to pulverize.

The cleaning of the coal may be less a problem, also, in this process, since this process can use fines to obtain the beneficial thixotropic properties associated with Brownian movement of the fines in the final suspensoid. Where the coal is to be cleaned, as for a coal gasification plant as described hereinafter, any of the conventional methods may be employed. For example, washing tables are frequently employed for the fines. The methods of cleaning are described at page 662 of the above referenced Kirk-Othmer Encyclopedia. The coal may be dry cleaned to eliminate drying, but there frequently results a dusty condition from air being blown through the oscillating perforated tables in the dry cleaning operation. Preferably, froth flotation will be employed in any cleaning operation employed, particularly for preserving the fines. Where it is desired to reduce the water contained on the clean coal, de-watering may be employed. As will be described in more detail later hereinafter, the coal may be brought to a moisture content that is optimum for the end use; for example, 6–8 percent by weight moisture has been found optimum for combustion. Ordinarily, a certain proportion of water can be tolerated and in fact beneficial, because the methanol will tend to take up or dissolve the water. In fact, the methanol will dissolve, or take up, the water and other alcohol soluble impurities and will frequently enable direct reduction in size of certain low grade coals, such as lignite and the like. Expressed otherwise, the methanol dissolution of the impurities will automatically cause fracturing of the low grade coals into smaller particles, since the water appears to be necessary in agglomerating the fine particles in the larger size lumps of coal. Thus, the de-watering operation may comprise simply vibrating screens or centrifuges, and avoid the necessity for thermal drying. Thermal drying may be employed, however, where the coal is to be sent to a coal gasification plant, such as employed for generating or producing the methyl fuel.

The term "methyl fuel" is employed herein to include methanol, ranging in purity from the substantially pure state to the crude alcohols produced by the gasification of a coal followed by a methanol, or alcohol, synthesis operation. Expressed otherwise, the methyl fuel may comprise methanol or a mixture of the lower alcohols containing 1–4 carbon atoms, inclusive. The methyl fuel may be produced at a site closely adjacent to the mined coal or it may be transported into the area where the liquid-solid suspensoid of this invention is prepared.

The gasification of coal is also described in the above referenced Kirk-Othmer Encyclopedia and numerous other publications, the contents of which are incorporated herein by reference. There have been a host of recently reported developments facilitating gasification of coal; alone and including refinements, such as methane synthesis. For example, the OIL AND GAS JOURNAL alone has carried a plurality of such reports in 1972–73; see issues of July 24, 1972 reporting cutting cost of synthetic natural gas (SNG) by one-half; Oct. 16, 1972 re sequential-step gasification process; and Jan. 22, 1973 re "The Lurgi Process Route Makes SNG from Coal", pages 90–92, including flow diagrams and gasifier vessel cross section. In these reported processes, steam and/or industrial oxygen is employed to produce carbon monoxide and hydrogen in accordance with Equation I.

$$\text{HOH (steam)} + O_2 + 3C\text{ (coal)} \rightarrow 3CO + H_2 \qquad \text{(I)}$$

A portion of the gas is subjected to a shift reaction with steam to produce hydrogen for hydrogen enrichment in accordance with Equation II.

$$CO + \text{HOH (steam)} \rightarrow CO_2 + H_2 \qquad \text{(II)}$$

The $Co_2$ is scrubbed from the gaseous product, leaving hydrogen. The hydrogen is admixed with the gaseous products of Equation I to produce a synthesis gas having the desired ratio of $H_2$ to CO before being sent to the methanol synthesis plant for synthesis of the methanol.

In the methanol synthesis plant, the respective constituents, such as carbon monoxide and hydrogen, are combined to snythesize the methanol. This synthesis of methanol is described at pages 370–398 of Vol. 13 of the above referenced Kirk-Othmer Encyclopedia and that descriptive matter is incorporated herein by reference. Ordinarily, the carbon monoxide and hydrogen will initially come from the synthesis gas prepared from the gasification of coal in the coal gasification plant. As indicated, care must be taken to control the ratio of hydrogen to carbon monoxide, the temperature and the pressure to obtain better yields of methanol. For example, in a conventional process, the thermodynamics favor methanation when the hydrogen and carbon monoxide are sought to be combined with a ratio of hydrogen to carbon monoxide greater than about 2. Nevertheless, yields of from 12–15 percent of that theoretically possible are obtained on single passes, with as much as 26 percent being reported. In addition, the respective off-gases can be recycled to obtain excellent results. For example, if methanation occurs, the methane that is produced is an excellent constituent for the synthesis of methanol. The newer processes, such as the Imperial Chemical Industries, Ltd. (ICI) Low Pressure process, developed circa 1966–67, achieve even better results. The methanol synthesis reaction can now be carried out over an improved catalyst at temperatures as low as 200°–300° F and only 3,000, or less, pounds per square inch (psi); contrasted with the older conventional processes that required 400° F and 8,000 psi. Pressure can be lower if the temperature is higher.

The new ICI Low Pressure process has been and is being employed commercially and is described in printed publications, the pertinent portions of which are incorporated herein be reference, so it need not be described in detail herein. For example, Jim Morrison reports in an article entitled "Here's How ICI Synthesizes Methanol at Low Pressure", OIL AND GAS JOURNAL, Vol. 66, Pages 106–9, Feb. 12, 1968, on one commercial installation. The reported ICI Low Pressure process operated on steam-naphtha reforming, but was operable on any source of carbon monoxide and hydrogen in the proper proportions. It employed a copper catalyst instead of the usual zinc-chromium catalyst and operated at 480° F and only 710 psi. The process, including economical refining steps, produces the methanol of 99.85 percent purity. Where the methanol is to be employed as a fuel, lesser purity can be tolerated for even greater economy. The synthesis of methanol from methane is also described in the above referenced Kirk-Othmer Encyclopedia and that descriptive matter is also incorporated herein by reference. Regardless of the process employed, very little energy need be wasted in either the coal gasification plant or the methanol synthesis plant, since any such energy source, such as off-gases that are not recycled, can be employed either in a power generation plant directly, the coal gasification plant or the methanol synthesis plant, as well as elsewhere in the overall system.

This invention may be understood by considering the method of preparing the fuel composition and then considering specific embodiments as illustrated in the figures.

Broadly stated, the method comprises the following plurality of steps. First, the coal particles are prepared to have a suitable fineness. Specifically, they are of −8 mesh Tyler standard screen size with the majority of the particles of −100 mesh size. In any event, the coal particles have a settling velocity of less than 2½centimeters per second in water. The coal particles are worked in the presence of the methyl fuel including the methanol so as to dissolve the water and other alcohol soluble impurities from the coal and activate and wet the surface of the coal particles. This step is apparently necessary, although the reason is not completely understood.

Finally, there is prepared a combustible pseudothixotropic liquid-solid suspensoid having the worked coal particles, that have been worked to dissolve the alcohol soluble impurities, substantially uniformly distributed in the methyl fuel solution containing the alcohol soluble impurities dissolved from the coal particles. The suspensoid includes 50–80 percent by weight of the worked coal particles and has shear thinning rheological properties so as to be pumpable with a lower apparent viscosity than its at-rest viscosity. Moreover, the suspensoid can be pumped over long distances, and/or stored; and still retain its shear thinning rheology and flowable property. The coal particles are held in suspension in the suspensoid by even low intensity stirring, even in storage; and are readily converted, even after quiescent storage, to a uniform suspensoid by a relatively high stirring, or any sort of induced turbulence.

One embodiment of the invention can be understood more readily by referring to FIG. 1. Therein, the coal from a source, such as bin 11, is fed through a suitable crusher 13 where it is reduced to the desired degree of fineness. Preferably, the coal particles being discharged from crusher 13 will have a maximum of about one-fourth inch in lateral dimensions. Any of the conventional commercially available crushing and grinding equipment may be employed as the crusher 13. These include roll crushers, hammer mills, cage mills, ball mills and the like. Economical and efficient equipment can be used here, since there is no great need for finesse.

If desired, the ground coal can be dried in a dryer 14. The dryer 14 is an enclosed dryer in which the water can be recovered. The water recovered can be used in an alcohol manufacturing plant or for other purposes at a remote facility in which water is scarce. Drying apparatus is conventional and may employ either coal fired heat or other suitable heat, as desired. As is well recognized, the water will ordinarily come off in vapor form such that it will be readily condensed by apparatus appropriate to the locale. For example, in colder temperature locales, such as Alaska, water vapor can be readily condensed by suitable conduits; whereas in other locales, it may require finned heat exchange apparatus with blowers or the like for blowing ambient cooling air past the contained water vapor.

On the other hand, the crushed coal may be sent directly to the slurrying means (SLURRY MEANS) 15, as by conveyors or the like shown by line 17. If desired, of course, the combination may be employed in which a portion of the coal is dried and a portion is not dried. It has been found advantageous to tailor the coal moisture content for the end use. For example, if it is to be separated and burned, it is preferable to bring it to a moisture content of 6–8 percent by weight. Surprisingly, the methyl fuel can later be separated to leave the coal at this optimum moisture content.

The methyl fuel is fed to the slurrying means 15 from suitable source, such as container 19. Ordinarily, the container 19 will comprise storage tanks, although tank cars or the like can be employed if desired.

In the slurry means 15 the particulate coal and the methyl fuel are admixed in the desired proportions and sent to storage, such as storage tank 21. In the slurrying means, a slurry is formed, even though the slurry cannot be pumped over long distances and the coal particles will tend to settle therefrom when stored. This is simply a mixing apparatus in which the alcohol and the coal particles are admixed together and pumped to the storage tank 21. It is preferred that less than 50 percent by weight of coal is employed in the slurry with the majority of the slurry being comprised of the methyl fuel, including methanol. The slurry of the coal and methyl fuel is stored for the desired interval; for example, from one to many days or weeks. Preferably, the container 21 is fluid tight such that the alcohol will not vaporize and the storage can be indefinite. When it is desired to produce the shear thinning liquid-solid suspensoid of this invention, referred to as METHACOAL, the slurry is sent to the pulverizer 23 for further reduction in size of the coal particles, as indicated by line 25. The transport through line 25 to the pulverizer 23 is preceded, if the coal has separated, by suitable vigorous agitation of the slurry to again suspend the coal particles in the methyl fuel. The agitation may be done by conventional stirrers in the storage tank 21. Before the coal particles can settle out again, the slurry is pumped through the line 25 by suitable conventionally available pumps designed to handle such slurries; for example, the drilling mud pumps or cement pumps employed in oil well drilling and completion operations. The pulverizer 23 may comprise any of the satisfactory crushing and grinding, or comminution, apparatus that will produce the desired size coal particles. These may comprise the rotary mills, the muller mills or ball mills. A particularly preferred type mill is the cage-type impact mill with counter-rotating cages, since the cage mills can be operated to provide a discharge with very nearly the optimum particle size and distribution. Of course, the predominant size is controlled by the mill rotating speed, feed rate and the amount of dilution of the feed slurry.

The pulverizer discharge is then transported, as indicated by line 27, to a suitable screen 29. The transportation may be by suitable troughs, pumped through conduit, or the like. The screen 29 is chosen such that the coal particles passing through to the thickener 31 will have sufficient fineness to assure good combustion; if later separation is to be made and the coal is to be burned as pulverized coal. Generally, the screen 29 will have a mesh size somewhere between 16 and 28 mesh, although 8 mesh screen can be employed. The screening also serves as a means of continuously monitoring the pulverizer performance, since the oversize from the screen is returned to the pulverizer 23, as indicated by the line 33. Since substantially all of the liquid methyl fuel passes through the screen to the thickener 31, the oversize may be returned by suitable conveyors or the like. The oversize may be sent to storage, to the line 25 or directly to the pulverizer 23 as desired.

As indicated, the screen underize material and the liquid flows, or is pumped, to the thickener 31 where the excess methyl fuel is removed as thickener overflow. The overflow is returned to storage, as indicated by line 35. If desired, the overflow can be returned to the inlet to the slurry means 15, as indicated by the dashed line 37. Specifically, the thickener 31 may comprise a centrifuge, either the solid bowl or perforate bowl type, or other separation equipment, for separating the slurry into an overflow and underflow. The overflow is substantially supernatant liquid. The underflow is the liquid-solid suspensoid of this invention.

Such thickener apparatus is commercially available and need not be described herein. One satisfactory type of perforated centrifuge is disclosed in U.S. Pat. No. 3,433,312, and the contents of that patent are incorporated herein by reference for details omitted herefrom.

The underflow from the thickener 31 is sent to storage, such as storage tank 39. Preferably, the shear thinning, thixotropic liquid-solid suspensoid represented by the underflow is maintained with the solid particles dispersed substantially uniformly therethrough by combination of the low intensity stirring, or low agitation, and Brownian movement. The suspensoid preferably contains from 50–80 percent by weight of the coal particles of the size delineated hereinbefore so as to have the shear thinning rheology and other desirable thixotropic properties delineated hereinbefore. The suspensoid may be stored for as long as desired, since the storage tank 39 is preferably enclosed and fluid tight to prevent vaporization of the metyl fuel or any constituent thereof.

It is noteworthy in this respect that the methyl fuel, regardless of whether it is relatively pure methanol or a commercially prepared alcohol containing a major proportion of methanol, will dissolve the water and other alcohol soluble impurities from the coal so that the liquid component of the suspensoid is itself a solution. The liquid solution may interact with the coal in some way not completely understood to help; in combination with the critical particle size, shape and content; impart the desired rheological properties delineated hereinbefore.

In any event, the suspensoid is transported to a destination; as by being tansported to a using destination by the illustrated pipe line, ship, barge, railroad tank car, or tank trucks, or other suitable means.

If the thixotropic suspensoid, METHACOAL, is pumped into the pipe line, it may have its pressure elevated at stages along the pipe line, if a sufficient length, by conventional pumping means. For example, centrifugal pumps with conventional wear resistant coatings, such as silicon carbide or Stellite, on the impellers may be employed advantageously in the pumping means for pumping the suspensiod through the pipe line to a destination. If desired, of course, positive displacement pumps, such as employed in pumping drilling fluid or cement slurry, can be employed. The pipe line is a conventional pipe line such as formed by welding together wrought iron pipe in accordance with conventional engineering standards and criteria. Suitable surge tanks and pumping means may be connected with the pipe line by appropriate valving. A destination may comprise a using facility or a storage facility. The destination may, in fact, comprise a combination of these, as for providing shipping facilities for loading ships, rail cars or trucks for shipment to more distant locales or other parts of the world. Ordinarily, it is considered advantageous in the continental United States, or the North American Continent, to employ pipe line to the destination, since the hydraulic transport is most economical method of transportation.

At the ultimate using destination, the liquid-solid suspensoid, METHACOAL, may be employed as a fuel for heating; for utility, such as a power plant; or for a process. On the other hand, it may be separated into its constituents of coal and the methyl fuel and the coal employed as a fuel for a utility or industrial process or in the production of synthesis gas or the like having either low or medium heat contents, or even for a synthetic natural gas. The methyl fuel may be employed in a wide variety of applications; including peaking gas turbines, combined-cycle power generation, gasoline additive, either as an extender or for conversion to gasoline in accordance with recently patented processes, as a natural gas fuel supplement, having 824 BTU's (British Thermal Unit) per standard cubic foot, in fuel cells, or as a raw product to the chemical industry. One important facet of this invention as indicated hereinbefore, is that the methyl fuel can be separated from the coal at low temperatures, depending on the composition and slightly above 150° F, and leave the coal at near its optimum moisture content for combustion.

Conventional shell-tube vessels enable flowing the suspensoid through the tubes and thereafter flashing off the methyl fuel without admixture with the hot gases in the shell. Therefore, relatively uncontaminated methyl fuel is obtained from the flash vessel.

The pre-slurring and storing of the coal-alcohol slurry will effect significant reductions in milling power requirements resulting from penetration of the coal particles by the alcohol in the methyl fuel. Moreover, the preforming and storing of the coal-alcohol slurry causes the individual particles of coal, when later comminuted, to tend toward more desirable shapes, such as the lenticular, platey, and irregular shapes that have lower settling velocities.

Figure 2:
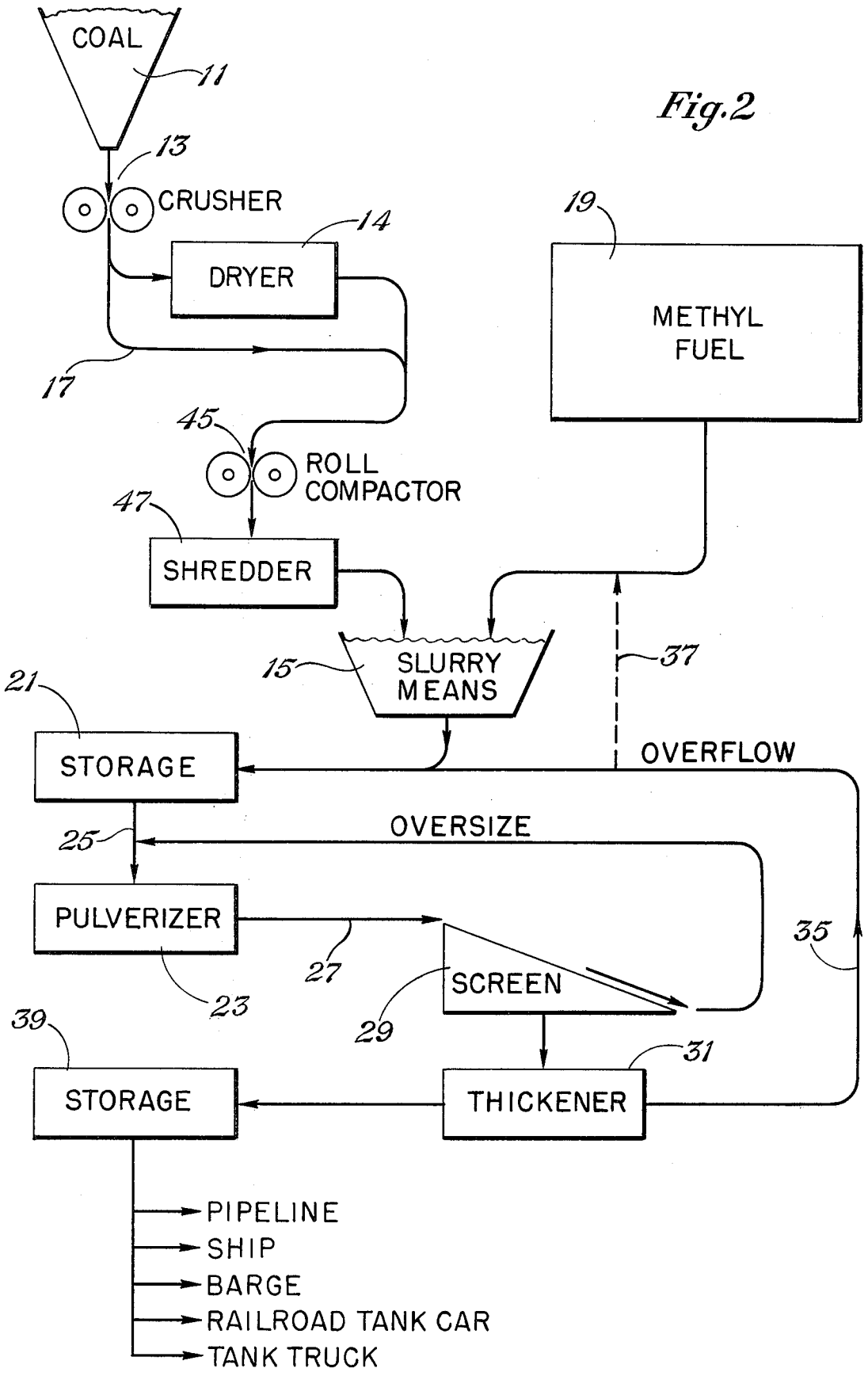
FIG. 2 is a schematic diagram of another embodiment of this invention.

There are various means available for effecting size reduction and controlling the characteristics of the particulate coal produced to assure a maximum production of the elongate, platey, and irregularly shaped particles, including a wide variety of particle shapes, for more nearly perfect shear thinning thixotropy. One satisfactory embodiment is illustrated in FIG. 2. Therein, the coal from bin 11 is crushed in crusher 13. The resulting comminuted coal is sent to a roll compactor 45, either directly via line 17 or through dryer 14, as described hereinbefore with respect to FIG. 1. The roll compactor 45 is force fed to form a planar, board-like slab of coal. This process imposes great internal shear and tearing forces during compaction and consequent induced solids flow. The material is essentially reformed in that all of the original parting planes, interstitial openings, individual particles and parting interfaces are destroyed and re-oriented. The re-orienting has a tendency to form schistose-like material with substantially parallel planes. The slabs of coal are then sent from the roll compactor 45 to the shredder 47. In the shredder 47, the slabs of coal are pulverized to produce different types of particles from the original coal. Specifically, the individual particles will be predominantly elongate, platey and irregular; as is desired to effect mechanical stabilization of the liquid-solid suspensoid METHACOAL. Specifically, the shredder 47 may be a hammer mill or cage impactor to form the desired particles. The resulting particles of coal are then sent to the slurrying means 15 where the remainder of the process is essentially as described hereinbefore with respect to FIG. 1.

When the resulting liquid-solid suspensoid is even gently stirred, it will effect a total mass movement to ensure homogeneity of the suspensoid. If desired, or necessary, it may be allowed to stand completely still in storage and then be homogenized just prior to removal from storage.

Certain types of vibration may cause a progressive collapse of the mechanical liquid-solid soliquoid, or suspensoid, and effect a jigging action. The jigging action can produce compaction and loss of the shear thinning rheological characteristics of the fluid upon protracted storage. Fortunately, however, the liquid-solid suspensoid can be readily returned to its previous shear thinning, pseudo-thixotropic suspensoid state if simply stirred or agitated. Often, simple application of vibration to the mass will return it to a fluid state. Such vibration, of course, must be substantially different in intensity, frequency and direction from that which caused the compaction in the first instance.

If desired, additional additives to impart more nearly perfect shear thinning thixotropic rheological characteristics to the liquid-solid suspensoid can be employed. Suitable additives include the conventional shear thinning additives that are also combustible and derived from cellulose fibres. Typically, these may be carboxymethyl cellulose, carboxyethyl cellulose, carboxymethyhydroxyethyl cellulose, starch and the like. Other well known shear thinning additives can readily be found in the drilling mud and water flooding technology for oil field operations.

Moreover, chemical additives may be employed for other purposes. For example, calcium hydroxide may be employed to fix sulfur into the slag or ash to prevent its being emitted as a polluting gas following combustion.

The following examples illustrate embodiments of this invention that have been found satisfactory.

EXAMPLE I

Anthracite coal was crushed to −4 mesh Tyler standard screen size and mixed with methanol and stored for a period of about two weeks. Thereafter, the coal in the presence of the alcohol was further crushed and screened such that the coal all passed through a 16 mesh Tyler standard screen with the majority of the particles passing through a 100 mesh screen. Excess alcohol solution of the water and other alcohol soluble impurities from the coal was decanted to leave about 70 percent by weight of coal in the admixture.

The resulting admixture appeared to be a black mass and looked like a solid. When subjected to shear, however, its viscosity became much less and it was readily flowable—to flow like a liquid. When tested on suitable rheological testing apparatus, such as a rotating cylinder, the shear stress remaining constant, the liquid-solid suspensoid was demonstrated to be truly thixotropic and exhibited the shear thinning in which the shear stress decreased with time and stress.

It is noteworthy that when this admixture was completely dried and the resulting particles of coal again admixed with methanol without any working in the presence of methanol, the same rheological properties were not obtained. The reasons for this latter occurrence are not completely understood.

A plurality of other compositions employing crude alcohol such as prepared from the methanol synthesis process as well as those available from other processes, were employed. A wide variety of coals having essentially the delineated particle sizes and prepared in essentially the same way with a particular methyl fuel with which they were tested all formed liquid-solid suspensoids exhibiting the shear thinning rheological characteristics, and being readily converted to a semi-liquid form that could be pumped as a liquid even though upon rest, they appeared to be a solid. Solid loadings as high as 80 percent by weight of coal have been demonstrated to be feasible and obtain the same shear thinning rheological properties. Greater than about 80 percent begins to effect a moistened mass that resists flow when shear is applied. Less than about 50 percent by weight of solid and the slurry becomes too dilute to exhibit the shear thinning properties.

The liquid-solid suspensoid, METHACOAL can be burned, per se, with a very low level pollutants being emitted. On the other hand, the constituents can be separated and each burned with their advantageous characteristics, particularly where the coal has a low sulfur content.

EXAMPLE II

This example illustrates that the constituents of the fuel composition can be separated and retain substantially their original characteristics.

The anthracite coal of Example I was dried to its optimum moisture content of 7 percent by weight and then mixed with methyl fuel comprising principally methanol to form the suspensoid of this invention. After turbulence, shear, storage and the like for several weeks, the methyl fuel was vaporized from the coal at about 152° F. The coal had substantially its original characteristics, including its optimum moisture content.

This invention portends dramatic improvements in the long range energy picture for the United States, as well as elsewhere in the world. Economical fuel may be produced and exported from an environment and afford an economical fuel at a using destination at about 50 percent of the current price of crude oil, yet the resulting fuel will be less polluting, since it will have a very low sulfur content. Moreover, the coal-methyl fuel shear thinning liquid-solid suspensoid burns with a lower temperature flame, such that less of the nitrogen oxides are formed with consequently less pollution, as compared with conventional fuels. The coal is very economical when hydraulic transport in the methyl fuel based suspensoid is employed, as in this invention. The methyl fuel that is employed in the suspensoid burns with a clear colorless flame and substantially no pollution. The methyl fuel is primarily methanol, which has an octane rating within the range of 92–106. As a high performance fuel, it can be burned with about one tenth the emissions of gasoline or similar polluting fuels. The methyl fuel-coal suspensoid presents no problems in storage and shipment and can be contained in conventional fuel tanks and transported by any conventional means.

While methods have been described hereinbefore in which the size reduction follows storage of a slurry of alcohol and coal particles, other methods may be employed. For example, there may be a size reduction of the dry coal but it must be followed by intensification, or working in the presence of the alcohol. For example, it is possible to employ the methyl fuel in going through a muller mill with the particles of comminuted coal to obtain the desired intensification.

From the foregoing, it can be seen that this invention provides a fuel composition that has one, several or all of the following features delineated hereinbefore as desirable and not heretofore provided by the prior art.

1. It provides a fuel composition produced from economical combustible carbonaceous particles wherein the basic fuel constituents are carbon particles and methyl fuel, including methyl alcohol; alone or in admixture with ethyl alcohol and higher alcohols, water and other alcohol soluble constituents of the particles, such as coal.

2. This invention provides one or more of the features 1–7 delineated hereinbefore.

3. A fuel composition is provided in which suspended particulate carbonaceous solid is sufficiently small to allow for efficient combustion whether burned as the soliquiod fuel, METHACOAL; or separated for burning of the coal as pulverized coal.

4. Also, this invention provides a fuel composition which has features 8–11.

5. Specifically, the invention provides a fuel composition in which the amount of particulate material reduced to very fine particle sizes, which have a high ratio of surface area to particle volume, is minimized to prevent excessive amount of alcohol or alcohols in the methyl fuel being required for particle surface coating. Excessive surface area per unit volume of particulate coal would limit the proportion of coal to alcohol which can be obtained and would, therefore, adversely affect the economics inherent in the fuel. The unit cost of alcohol is from about 3 to about 10 times as great as that of coal. Consequently, less than one percent of the solids should have a particle size less than 10 microns. While particle sizes below about 0.1 micron may be partially beneficial from Brownian movement, it is not desirable to produce very much material in this range, since even at 0.001 millimeter, the ratio of area to volume is 1,000:1.

Having thus described this invention, it will be understood that such description has been given by way of illustration and example and not by way of limitation, reference for the latter purpose being had to the appended claims.

What is claimed is:

1. A fuel composition comprising a combustible, pseudo-thixotropic liquid-solid suspensoid including a critical proportion of combustible carbonaceous particles having a critical settling velocity substantially uniformly dispersed in a solution of methyl fuel including methanol, water and other alcohol soluble constituents of said carbonaceous particles; said carbonaceous particles being present in a proportion of 50–80 percent by weight; said carbonaceous particles being sized and shaped to have a settling velocity in water of less than 2½ centimeters per second and worked in the presence of said methanol so as to be wet by said methanol along all surfaces; said carbonaceous particles being held in suspension in said liquid-solid suspensoid by even low intensity stirring in storage and not separating out when pumped through a pipe line; said suspensoid having shear thinning rheological properties so as to be pumpable with a lower apparent viscosity than its at-rest viscosity.

2. The fuel composition of claim 1 wherein said combustible carbonaceous particles are of −8 mesh size with a majority of the particles being of −100 mesh size.

3. The fuel composition of claim 1 wherein said liquid-solid suspensoid includes a shear thinning additive for more pronounced shear thinning properties.

4. The fuel composition of claim 1 wherein there is included a sulfur-fixing additive for fixing sulfur in the slag and ash during combustion.

5. The fuel composition of claim 1 wherein said fuel composition is cooled to a temperature of less than 32° F for being pumped through a subterranean pipe line.

6. The fuel composition of claim 1 wherein no more than one percent of said combustible carbonaceous particles have sizes of less than 10 microns (0.01 millimeter) in lateral dimensions.

7. The fuel composition of claim 6 wherein there are some combustible carbonaceous particles having a size less than 0.1 micron (0.0001 millimeters) for Brownian movement phenonmeon to improve thixotropy and suspension.

8. A method of preparing a fuel composition comprising the steps of:

a. preparing combustible carbonaceous particles of −8 mesh sizes with a majority of the carbonaceous particles being of −100 mesh size and having settling velocities of no more than 2½ centimeters per second in water;

b. working said combustible carbonaceous particles in the presence of methyl fuel including methanol so as to dissolve water and other alcohol-soluble impurities therefrom and activate and wet the surfaces of said combustible carbonaceous particles; and c. preparing a combustible, pseudo-thixotropic liquid-solid suspensoid having said worked combustible carbonaceous particles that have been worked to dissolve the alcohol-soluble impurities therefrom substantially uniformly distributed in the methyl fuel solution containing the alcohol soluble impurities dissolved from said combustible carbonaceous particles; said suspensoid including 50–80 percent by weight of said worked combustible carbonaceous particles and having shear thinning rheological properties so as to be pumpable with a lower apparent viscosity than its at-rest viscosity.

9. The method of claim 8 wherein said combustible carbonaceous particles comprise coal; the steps a. and b. are performed by crushing coal, slurrying the crushed coal with said methyl fuel, storing the resulting slurry; thereafter comminuting said coal in said methyl fuel and screening the comminuted coal; returning any oversized coal to storage; and performing step c.

10. The method of claim 9 wherein said slurry contains less than about 50 percent by weight coal and is thickened by returning the excess methyl fuel by an over flow to storage.

11. The method of claim 8 wherein said combustible carbonaceous particles comprise coal; the steps a. and b. are performed by the steps of:

a. crushing said coal;

b. compacting said crushed coal into slabs and the like to reformulate the particles of coal;

c. transforming the compressed coal into schistose-like particles of coal having a desired plate-like characteristic of thin particles of substantially parallel planes of cleaveage so as to have the desired low settling velocity;

d. slurrying the crushed schistose-like particles of coal with said methyl fuel to form a slurry;

e. storing the resulting slurry;

f. thereafter comminuting said coal in said methyl fuel and screening the comminuted coal, returning any oversize coal to storage; and g. performing step c.

12. The method of claim 11 wherein said slurry contains less than 50 percent by weight of said coal particles and is thickened by returning excess methyl fuel via an overflow to storage.

13. The method of claim 8 wherein said carbonaceous particles comprise coal; said suspensoid containing said coal particles in methyl fuel are cooled to a temperature below 32° F and pumped through a subterranean pipe line.

* * * * *